US010262620B2

(12) United States Patent
Zhang

(10) Patent No.: US 10,262,620 B2
(45) Date of Patent: Apr. 16, 2019

(54) DISPLAY PANEL AND OVERDRIVING CIRCUIT SYSTEM THEREOF

(71) Applicant: Shenzhen China Star Optoelectronics Technology Co., Ltd., Shenzhen, Guangdong (CN)

(72) Inventor: Xianming Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 185 days.

(21) Appl. No.: 15/305,343

(22) PCT Filed: Sep. 14, 2016

(86) PCT No.: PCT/CN2016/099074
§ 371 (c)(1),
(2) Date: Oct. 19, 2016

(87) PCT Pub. No.: WO2018/028021
PCT Pub. Date: Feb. 15, 2018

(65) Prior Publication Data

US 2018/0182347 A1 Jun. 28, 2018

(30) Foreign Application Priority Data

Aug. 11, 2016 (CN) ..... 2016 1 0663106

(51) Int. Cl.
*G09G 3/36* (2006.01)

(52) U.S. Cl.
CPC ..... *G09G 3/3696* (2013.01); *G09G 3/36* (2013.01); *G09G 3/3607* (2013.01); (Continued)

(58) Field of Classification Search
CPC ..... G09G 3/3696; G09G 3/3607; G09G 2310/08; G09G 2320/0257; G09G 2320/0271; G09G 2320/041
See application file for complete search history.

(56) References Cited

U.S. PATENT DOCUMENTS

2007/0075951 A1 4/2007 Lin
2010/0214271 A1* 8/2010 Mizusako ..... G09G 3/36 345/204
2016/0149574 A1* 5/2016 Cui ..... H01K 19/00369 345/690

FOREIGN PATENT DOCUMENTS

CN 1804986 A 7/2006
CN 2831632 Y 10/2006
(Continued)

*Primary Examiner* — Charles V Hicks
(74) *Attorney, Agent, or Firm* — Andrew C. Cheng

(57) ABSTRACT

The invention provides an overdriving circuit system of a display panel. The overdriving circuit system includes a detecting circuit, a timing controller and a storage device. The detecting circuit is for detecting a temperature of the display panel to generate a corresponding voltage. The storage device is for storing multiple overdriving tables. The timing controller is for selecting the overdriving table corresponding to the voltage from the overdriving tables as per the voltage. The overdriving circuit system takes the influence of temperature in consideration, detects the temperature of the display panel and uses corresponding overdriving tables at different temperatures, and therefore can avoid the occurrence of smear phenomenon.

5 Claims, 2 Drawing Sheets

300

(52) U.S. Cl.
CPC . *G09G 2310/08* (2013.01); *G09G 2320/0257* (2013.01); *G09G 2320/0271* (2013.01); *G09G 2320/041* (2013.01)

(56) References Cited

FOREIGN PATENT DOCUMENTS

| | | | |
|---|---|---|---|
| CN | 1901023 | A | 1/2007 |
| CN | 1603917 | A | 8/2007 |
| CN | 101101735 | A | 1/2008 |
| CN | 101266764 | A | 9/2008 |
| CN | 101477786 | A | 7/2009 |
| CN | 202110797 | U | 1/2012 |
| CN | 102368381 | A | 3/2012 |
| CN | 202615079 | U | 12/2012 |
| CN | 103187039 | A | 7/2013 |
| KR | 1148778 | B1 | 5/2012 |

* cited by examiner

DISPLAY PANEL AND OVERDRIVING CIRCUIT SYSTEM THEREOF

TECHNICAL FIELD

The invention relates to the field of liquid crystal display, and more particularly to a display panel and an overdriving circuit system thereof.

DESCRIPTION OF RELATED ART

In a display process of a liquid crystal display (LCD) panel, in order to achieve a target graylevel required by display as soon as possible, an OD (overdriving) technology generally is employed, and an OD table is used to make a current graylevel reach a target graylevel within one frame as far as possible. If there is no OD table, because of the influence of liquid crystal response speed, it will result in that a displayed image requires several frames to reach a desired target graylevel, so that the image appears smear phenomenon. As shown in FIG. 1, in the situation of without using OD, it needs about 3 frames or 4 frames to achieve the target graylevel; and as shown in FIG. 2, in the situation of using OD, it only needs 1 frame to achieve the target graylevel.

Therefore, in a current driving of LCD panel, the OD is adopted. However, in an actual overdriving process, often there are the following questions that: the OD is insufficient, i.e., a graylevel after overdriving still is far lower than the target graylevel; or the OD is excessive, i.e., a graylevel after overdriving is far higher than the target graylevel. Therefore, it can effectively meet the requirement of the graylevel after the overdriving being equal to the target graylevel, so that the smear phenomenon becomes more serious.

SUMMARY

In order to overcome the shortcomings of the prior art, the invention provides an overdriving circuit system of a display panel. The overdriving circuit system includes a detecting circuit, a timing controller and a storage device. The detecting circuit is for detecting a temperature of the display panel to generate a corresponding voltage. The storage device is for storing a plurality of overdriving (OD) tables. The timing controller is for selecting the overdriving table corresponding to the voltage from the plurality of overdriving tables according to the voltage.

Preferably, each of the plurality of overdriving tables is corresponding to data required for overdriving of the display panel in a temperature range.

Preferably, the selected overdriving table is the overdriving table corresponding to a temperature range which the temperature corresponding to the voltage falls into.

Preferably, the detecting circuit includes a constant voltage, a fixed resistor and a thermal resistor. The thermal resistor has a resistance varied along with a change of the temperature of the display panel. The detecting circuit is for generating the voltage according to a divided voltage formed by the fixed resistor and the thermal resistor dividing the constant voltage.

Preferably, the detecting circuit includes an amplifier for amplifying the divided voltage.

Efficacy of the invention is that: the overdriving circuit system of a display panel according to exemplary embodiments of the invention takes the influence of temperature in consideration, detects the temperature of the LCD panel and uses corresponding overdriving tables at different temperatures, and therefore can meet the requirement of the graylevel after overdriving being substantially equal to the target graylevel and avoid the occurrence of smear phenomenon consequently.

BRIEF DESCRIPTION OF THE DRAWINGS

The above and other objectives and advantages of exemplary embodiments of the invention will be more apparent from the following detailed description taken in conjunction with drawings of exemplarily illustrating embodiments, in which.

DETAILED DESCRIPTION OF EMBODIMENTS

The following description with reference to accompanying drawings will help to fully understand various embodiments of the invention defined by claims and their equivalents. The following description includes a variety of specific details for helping understand, but these details merely are exemplary. Accordingly, it should be understood by those skilled in the art, in the case of without departing from the scope and spirit of the invention, various changes or modifications can be made to the embodiment as described herein. In addition, for the purpose of clarity and conciseness, description of well-known functions and structures will be omitted.

Figure 1:
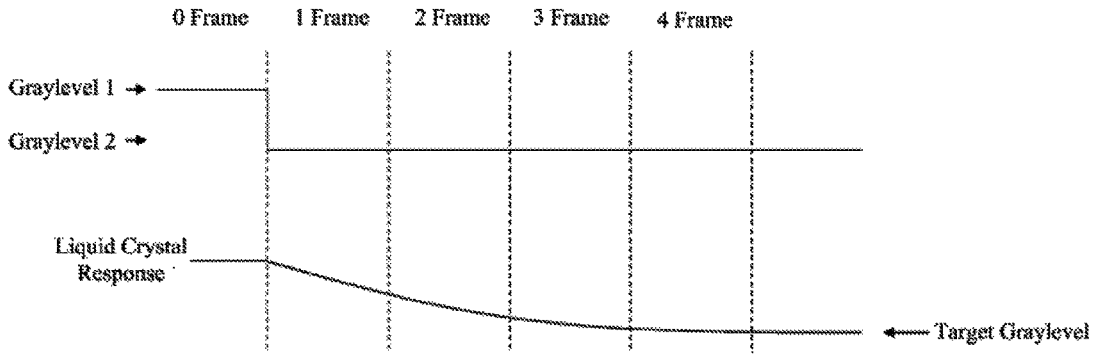
FIG.1 (Prior Art)
FIG. 1 is a process diagram of achieving a target graylevel in a situation of without using an overdriving.
Figure 2:
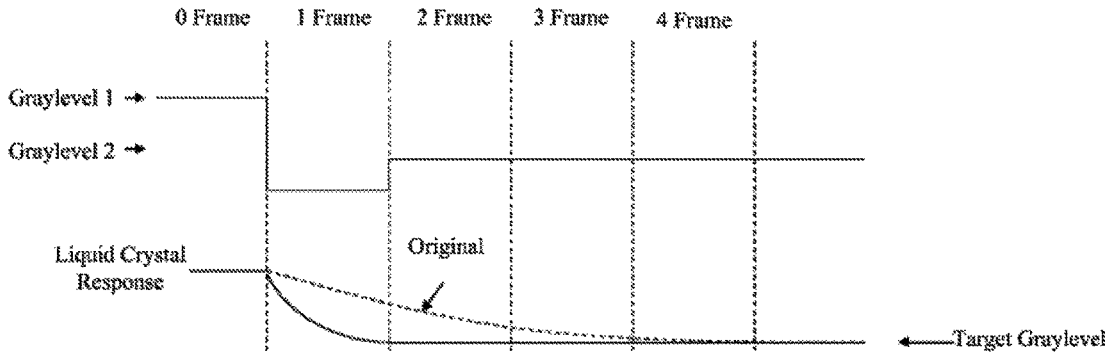
FIG.2 (Prior Art)
FIG. 2 is a process diagram of achieving a target graylevel in a situation of using an overdriving.
Figure 3:
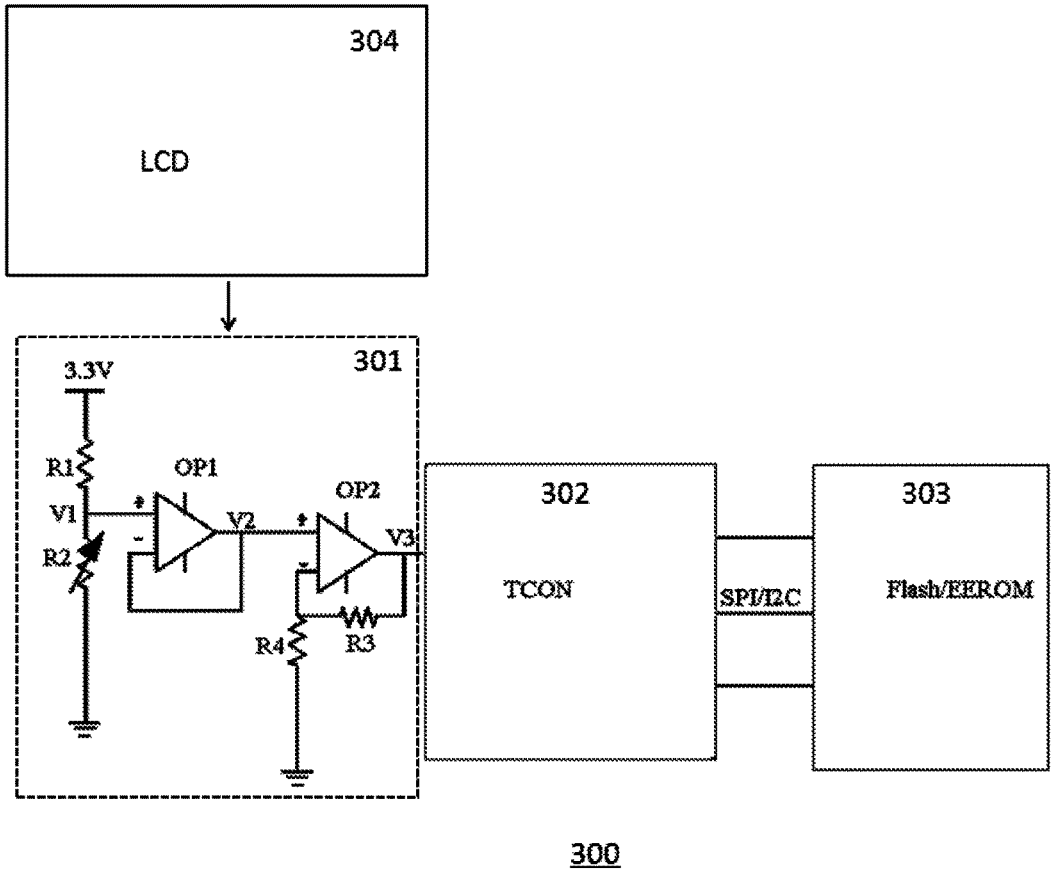
FIG. 3 shows an overdriving circuit system of a display panel according to an exemplarily embodiment of the invention.

FIG. 3 shows an overdriving circuit system of a display panel according to an exemplarily embodiment of the invention. As shown in FIG. 3, the overdriving circuit system 300 of a display panel includes a detecting circuit 301, a timing controller 302, a storage device 303 and a LCD panel 304.

The detecting circuit 301 is configured (i.e., structured and arranged) for detecting a temperature of the LCD panel 304. In the sensing unit 301, a thermal resistor R2 may be disposed on the LCD panel and configured for detecting the temperature of the LCD panel; when the temperature decreases, a resistance of the thermal resistor R2 is decreased, and when the temperature increases, the resistance of the thermal resistor R2 is increased. One terminal of the thermal resistor R2 and a resistor R1 with a predetermined resistance are serially connected to a voltage source (e.g., 3.3V), the other terminal of the thermal resistor R2 is connected to the ground. During a working process, the resistor R1 and the thermal resistor R2 produce a divided voltage V1 on a node therebetween, because the resistance of the thermal resistor R2 varies along with the change of the temperature, and therefore the divided voltage V1 varies along with the change of the temperature correspondingly, i.e., the divided voltage V1 is the expression of the temperature of the LCD panel.

A voltage value of the divided voltage V1 obtained directly is small, which goes against the accurate sensing of the timing control unit 302, and therefore the divided voltage V1 is amplified by a voltage follower and a voltage amplifier to thereby obtain a voltage V3. Referring to FIG. 3, the divided voltage V1 is input to a non-inverting input terminal of a voltage follower constituted by an amplifier OP1, a voltage V2 outputted from the voltage follower is input to an inverting input terminal of the voltage follower as well as a non-inverting input terminal of an amplifier OP2. An inverting input terminal of the amplifier OP2 is connected to the ground via a resistor R4 and further connected to an output terminal thereof via a resistor R3, and finally the voltage V3 is outputted.

The timing controller 302 detects the voltage V3 outputted from the amplifier OP2 and reads an overdriving table relevant to a temperature corresponding to the voltage V3 from the storage device 303 through a SPI (Serial Peripheral Interface) or I2C bus as per the voltage V3. Herein, the SPI or I2C only is exemplary, the invention is not limited to this, and any suitable types of transmission interfaces or buses may be adopted.

According to an exemplary embodiment, the storage device 303 may be a flash memory or an electrically erasable programmable read-only memory (EEPROM), but the invention is not limited to these and any suitable type of memories may be adopted.

The storage device 303 stores multiple (i.e., more than one) overdriving tables. At different temperatures, the liquid crystal has different response speeds; and therefore as per different temperatures, corresponding overdriving tables as required for overdriving of the LCD panel are selected. The overdriving table includes data required for the overdriving of the display panel. The overdriving tables are preset according to respective temperature ranges (or voltage ranges). For example, a working temperature range of the LCD panel 304 may be divided by using 10° C. (may be adjusted according to actual requirement) as an segment, each segment of temperature range is corresponding to one overdriving table. According to an exemplary embodiment, each segment of temperature range may be transformed to a corresponding voltage range according to the circuit structure of the detecting circuit, and therefore each voltage range is corresponding to one overdriving table. The timing controller 302 selects one overdriving table corresponding to a voltage range which the voltage V3 falls into based on the detected voltage V3. At different working temperatures, the LCD panel 304 is overdriven adaptable to (matched with) the working temperature according to overdriving data in the selected overdriving table, so as to avoid the OD to be insufficient or excessive.

The overdriving circuit system of a display panel according to an exemplary embodiment of the invention takes the influence of temperature in consideration, detects the temperature of the LCD panel and uses suitable overdriving tables at different detected temperatures, and therefore it can meet the requirement of the graylevel after overdriving being substantially equal to the target graylevel at different temperatures and consequently suppress the occurrence of the smear phenomenon.

The exemplary embodiment according to the invention is not limited to the above described embodiment, and various modifications in forms and details can be made in the range of the technical scheme conceived by the present invention.

Although the invention has been illustrated and described with reference to exemplary embodiment, those skilled in the art should be understood that without departing from the spirit and scope of the invention defined by claims, various modifications in forms and details can be made.

What is claimed is:

1. An overdriving circuit system of a display panel, comprising a detecting circuit, a timing controller and a storage device; wherein the detecting circuit is configured for detecting a temperature of the display panel to generate a corresponding voltage;

the storage device is configured for storing a plurality of overdriving tables; and the timing controller is configured for selecting the overdriving table corresponding to the voltage from the plurality of overdriving tables according to the voltage, wherein the detecting circuit comprises a constant voltage, a fixed resistor, a thermal resistor, a first amplifier and a second amplifier, the constant voltage, the fixed resistor and the thermal resistor are serially connected, the thermal resistor has a resistance varied along a change of the temperature of the display panel, the fixed resistor, the thermal resistor and a non-inverting input terminal of the first amplifier are connected together, an output terminal of the first amplifier, an inverting input terminal of the first amplifier and a non-inverting input terminal of the second amplifier are connected together, an output terminal of the second amplifier and an inverting input terminal of the second amplifier are electrically connected together, and the corresponding voltage is generated from the output terminal of the second amplifier.

2. The overdriving circuit system as claimed in claim 1, wherein each of the plurality of overdriving tables is corresponding to data required for overdriving of the display panel in a temperature range.

3. The overdriving circuit system as claimed in claim 1, wherein the selected overdriving table is the overdriving table corresponding to a temperature range which the temperature corresponding to the voltage falls into.

4. The overdriving circuit system as claimed in claim 2, wherein the selected overdriving table is the overdriving table corresponding to the temperature range which the temperature corresponding to the voltage falls into.

5. A display panel comprising an overdriving circuit system; wherein the overdriving circuit system comprises a detecting circuit, a timing controller and a storage device;

the detecting circuit is configured for detecting a temperature of the display panel to generate a corresponding voltage;

the storage device is configured for storing a plurality of overdriving tables, and each of the plurality of overdriving tables is corresponding to data required for overdriving of the display panel in a temperature range; and the timing controller is configured for selecting the overdriving table corresponding to the voltage from the plurality of overdriving tables based on the voltage, and the selected overdriving table is the overdriving table corresponding to a temperature range which the temperature corresponding to the voltage falls into, wherein the detecting circuit comprises a constant voltage, a fixed resistor, a thermal resistor, a first amplifier and a second amplifier, the constant voltage, the fixed resistor and the thermal resistor are serially connected, the thermal resistor has a resistance varied along a change of the temperature of the display panel, the fixed resistor, the thermal resistor and a non-inverting input terminal of the first amplifier are connected together, an output terminal of the first amplifier, an inverting input terminal of the first amplifier and a non-inverting input terminal of the second amplifier are connected together, an output terminal of the second amplifier and an inverting input terminal of the second amplifier are electrically connected together, and the corresponding voltage is generated from the output terminal of the second amplifier.

* * * * *